United States Patent [19]

Clinton et al.

[11] Patent Number: 4,504,172

[45] Date of Patent: Mar. 12, 1985

[54] CAISSON SHIELD FOR ARCTIC OFFSHORE PRODUCTION PLATFORM

[75] Inventors: John D. Clinton, London, England; Gerhard H. Reusswig, Irving, Tex.

[73] Assignee: Mobil Oil Corporation, New York, N.Y.

[21] Appl. No.: 512,803

[22] Filed: Jul. 11, 1983

[51] Int. Cl.[3] ..... E02B 17/00

[52] U.S. Cl. ..... 405/217; 405/195; 405/61

[58] Field of Search ..... 405/217, 203–209, 405/210, 61; 62/259, 260

[56] References Cited

U.S. PATENT DOCUMENTS

| | | | |
|---|---|---|---|
| 559,116 | 4/1896 | Baldwin | 405/204 X |
| 946,841 | 1/1910 | Gilman | 405/11 |
| 2,063,514 | 12/1936 | Meem | 405/203 X |
| 2,940,266 | 6/1960 | Smith | 405/204 |
| 4,188,157 | 2/1980 | Vigander | 405/207 X |
| 4,283,159 | 8/1981 | Johnson et al. | 405/203 X |
| 4,303,352 | 12/1981 | Marion | 405/207 X |
| 4,422,804 | 12/1983 | Gerwick et al. | 405/210 |
| 4,427,320 | 1/1984 | Bhula | 405/217 X |

FOREIGN PATENT DOCUMENTS

| | | | |
|---|---|---|---|
| 740900 | 6/1980 | U.S.S.R. | 405/207 |

*Primary Examiner*—Dennis L. Taylor

*Attorney, Agent, or Firm*—A. J. McKillop; M. G. Gilman; J. F. Powers, Jr.

[57] ABSTRACT

A caisson shield for the protection of an offshore production platform and, more particularly, a caisson shield for use in an arctic environment for the protection of the offshore structure in iceberg-infested waters which is capable of absorbing the destructive forces of an impact produced by a large iceberg. The caisson shield consists of an essentially annular concrete structure encircling at least the submerged support section of the offshore production platform including vertically upstanding concentrically spaced, annular side walls, a horizontal slab base resting on the marine bottom on which the side walls are supported, and a slab top supported on the side walls, and including annularly spaced internal radial partition walls whereby the entire overall caisson shield structure provides a generally toroidal configuration incorporating a plurality of closed compartments. In one enbodiment of the invention, located along the outer annular wall is a plurality of arcuate wall sections forming a series of arches and enclosed compartments between each arcuate wall section and the outer annular wall, which impart a "scallop-like" configuration to the outer circumference of the caisson shield. The "scallop-like" outer walls are capable of resisting and absorbing extremely high ice loads by being adapted to progressively crush the leading edge of an impacting iceberg and to thereby minimize the crush of the iceberg against the caisson shield before coming to rest against the shield.

17 Claims, 2 Drawing Figures

CAISSON SHIELD FOR ARCTIC OFFSHORE PRODUCTION PLATFORM

BACKGROUND OF THE INVENTION

1. Field of the Invention

The present invention relates to a caisson shield for the protection of an offshore production platform and, more particularly, a caisson shield for use in an arctic environment for the protection of the offshore structure in iceberg-infested waters which is capable of absorbing the destructive forces of an impact produced by a large iceberg.

More recently, the increased worldwide demand for hydrocarbons, such as oil and natural gas, has necessitated the investigation and exploitation of many new regions throughout the world, both on land and offshore. One of the regions which appears to be extremely promising in its potential for finding hydrocarbon fuels is the offshore arctic and subarctic area in proximity to Canada and Greenland. However, this area calves numerous icebergs each year, the size and shape of which are dependent upon their glacial source, climatic and hydrographic conditions determinative of their survival or deterioration, and the routes and distances over which the icebergs travel and are tracked, frequently over a period of several years, before their eventual destruction in the Northwest Atlantic Ocean. Some of these icebergs reach a magnitude having a mass larger than 180,000 tons and, when impacting against a structure, can produce immense destructive forces.

The offshore production platform, especially the support section thereof which is submerged below the marine surface, if exposed to the impact of large icebergs, in addition to experiencing localized or massive failures in the structure thereof, can to some extent slide along the marine floor which may conceivably cause damage to expensive and difficultly replaceable equipment and pipelines connected to the platform support structure. In order to counteract any substantial or massive foundation or support section failure of the offshore platform, the submerged support section of a self-protecting type of platform should be impressive in its mass and dimensions so that possible failure of structural and foundation components are limited to localized areas which may occasion only a brief and temporary suspension of platform operations when such an impact encountered reaches a maximum or extreme limit. In such an event, there is a definite possibility of damage being imparted to the pipeline and flowline connections to the structure of the offshore platform, and of substantial damage resulting to the structure itself, with the attendant risk of well conductor casings being severed from the offshore platform, in the case of drilling and well completion thereby resulting in a much greater economic loss than would be encountered as the result of a temporary shutdown of the platform.

2. Discussion of the Prior Art

Various solutions to the problems encountered in protecting offshore structures from damage caused by iceberg impact in iceberg-infested waters have been suggested in the prior art. Thus, Pearce et al. U.S. Pat. No. 4,245,929 discloses an offshore structure able to withstand ice forces generated by impinging ice sheets or icebergs in which at least the lower portion of the support structure of the offshore platform includes upper and lower differently sloped conical portions with respect to the walls thereof forming an inclination relative to the horizontal so as to receive and deflect ice masses moving into contact with the platform support structure. The particular structural selection of the conical wall structure is designed to cause the ice to tilt upwardly upon impinging against the support structure and to fragment itself while sliding off the support structure. The type of conical wall structure proposed in Pearce et al. does not appear to be adequate to withstand the impact of extremely large icebergs encountered in arctic or subarctic waters and is primarily intended for the purpose of deflecting relatively thin ice sheets rather than large and massive icebergs.

Howard U.S. Pat. No. 3,766,737 discloses an offshore platform which is encompassed, at a radial distance from the platform, by a circumferentially movable ice trenching machine which will circulate about the platform so as to fragment and remove ice in a circular path at a rate approximately equal to the rate of movement of the ice sheet towards the protected structure. Also this type of protective arrangement for offshore platforms is only adapted to protect the platform from the pressures of ice sheets and does not appear to provide any significant protection against the large destructive forces generated through impact by a massive iceberg.

Challine et al. U.S. Pat. No. 4,142,819 discloses an offshore platform in which the platform is of the gravitytype including a base resting on the marine floor and with an annular shell affording rigidity in the upward direction, such as a circular wall and diaphragms extending about the base portion of the platform so as to provide reinforcement therefore. This type of reinforcing support structure for the base of the offshore platform does not appear to be designed to withstand the impact of icebergs, particularly any relatively large and massive icebergs normally encountered in arctic and subarctic waters and thus would provide inadequate protection for the platform, thereby rendering it unsuitable for use in iceberg-infested waters.

SUMMARY OF THE INVENTION

In essence, the caisson shield pursuant to the present invention which encompasses the subsea support structure of the offshore platform is adapted to protect a marine bottom-supported platform from the impact of and resultant damage caused by massive icebergs and thus allows for the scaling down in size and mass of the offshore platform support section which is submerged to one which is adequate to normally resist external forces generated by drift ice, hydrodynamic forces, and relatively small icebergs.

The inventive caisson shield structure may thus be built economically within the context of the overall capital expenditures for an offshore platform installation of this type by being designed and constructed for local failure or only a relatively negligible along the marine floor imparted thereto when impacted against by a large, massive iceberg.

The caisson shield is a cellular or compartmented concrete structure which may be constructed using any of several well known conventional methods (e.g. slipforming), in essence, similar to and in a like manner as employed in the construction of concrete piers, caissons and dry docks.

Accordingly, it is a primary object of the present invention to provide a caisson shield for protecting an offshore production platform in iceberg-infested waters which is adapted to be utilized in the exploitation of arctic and subarctic offshore areas in which icebergs are likely to be encountered during at least some seasons of the year.

It is a more specific object of the present invention to provide a caisson shield for the protection of offshore platforms of the type described which consists of a massive annular and compartmented concrete structure resting on the marine bottom and extending upwardly towards the marine surface in an encircling and protective relationship about the offshore production platform, and being spaced from or allowing lateral movement relative to the platform.

Specifically, the caisson shield pursuant to the invention consists of an essentially annular concrete structure encircling at least the major portion of the submerged support section of the offshore production platform including vertically upstanding concentrically spaced, annular side walls, a horizontal slab base resting on the marine bottom on which the side walls are supported, and a slab top supported on the side walls, and including annularly spaced internal radial partition walls whereby the entire overall caisson shield structure provides a generally toroidal configuration incorporating a plurality of closed compartments.

In one embodiment of the invention located along the outer annular wall is a plurality of arcuate wall sections forming a series of arches and enclosed compartments between each arcuate wall section and the outer annular wall, which impart a "scallop-like" configuration to the outer circumference of the caisson shield. The "scallop-like" outer walls are capable of resisting and absorbing extremely high ice loads by being adapted to progressively crush the leading edge of an impacting iceberg and to thereby minimize the crush of the iceberg against the caisson shield before coming to rest against the shield. The radial partition walls forming the compartments and other wall structure of the caisson shield interiorly of the arcuately curved outer wall sections are designed to absorb the maximum anticipated ice thrust forces. This will allow for toleration of inelastic stresses and local punching failures of the outer wall sections of the caisson shield since this would be normally encountered in only one or at most a few compartments for any maximum anticipated impact force exerted by an abnormally or extremely large iceberg. In any event, it is anticipated that the caisson shield may conceivably slide along the marine floor when impacted against by an extremely large iceberg for only a very small distance while the maximum possible impact energy is being dissipated. This, of course, depends upon the relative virtual masses of the caisson shield and of the iceberg and the maximum thrust developed when the ice mass of the iceberg is crushed against the arched faces of the outer caisson shield wall.

In one particular embodiment of the caisson shield structure pursuant to the invention, the arrangement thereof is completely independent of the platform when it is positioned offshore. Thus, the annular caisson shield may be radially spaced from the offshore platform by a distance of as much as 15 to 25 meters. Inasmuch as only a few, if any, maximum sized credible icebergs may conceivably collide with the caisson shield structure during its intended life span, the probability of endangering the operation of the platform caused by sliding of the caisson shield along the marine bottom is virtually non-existent. Furthermore, any pipelines and flow lines leading towards and away from the offshore platform will, in all likelihood, be positioned so as to extend through a large keyway in the shape of a cutout or void provided in the base of the caisson shield, thus either resting on the marine floor or being buried in a manner whereby the structure has some freedom to slide along the marine bottom without in any manner damaging and endangering these platform installations. The configuration of the keyway is generally designed to allow for a considerable latitude of movement or sliding of the caisson shield in any direction along the marine floor.

In one particular embodiment of the invention, the caisson shield rises towards the marine surface and terminates at an adequate clearance of the top of the caisson shield, or the slab supported on the side wall structure thereof, below the marine surface so as to accommodate the draft of vessels used in normal marine traffic during platform operations.

The caisson shield is provided with the enclosing roof slab and with a ballasting and venting valve system for sinking the caisson shield on site through the intermediary of conventional marine equipment, such as barges having winches for lowering the shield in a slightly negatively-ballasted condition to a position resting on the marine floor. One or more upwardly reaching compartment extensions may be incorporated in the caisson shield to form ballasting and pumpout shafts for effectuating the control of caisson sinking and deballasting operations. The caisson shield may be submerged inshore to a sufficient depth to enable deck mating with the production platform, with the shaft extensions precluding any necessity for complex ballasting systems; however, the caisson shield should incorporate ballast and vent equalizers for common piping interconnection of the compartments. Pumpout and refloating operations may be effectuated in a straightforward manner, either inshore after deck mating with the platform, or offshore upon abandonment of the platform. The shaft extensions, basically steel caissons, may be removed after installation offshore and reinstalled if the platform and caisson shield are to be removed at the end of the field life.

Although the most practical utilization of the caisson shield is in a construction comprising a single or unitary monolithic structure, alternate methods of forming the iceberg barrier or shield of the same generally annular configuration can be contemplated, in essence, through the construction and assembly of a plurality of monolithic compartmented segments which are then keyed and interlocked together. The single monolithic structure has the advantages of being a simple construction, and provides for erection and installation concurrent with that of the offshore platform. Moreover, this type of construction affords an immediate and continuous protection against large icebergs over the lifespan of the production platform. The preferred configuration as a unitary monolithic structure would be built with the submerged platform support structure in a single graving dock, floated out after construction of the base and compartment walls to a height necessary for the floatation of both the offshore platform and the caisson shield, and completed while in a floating mode by slip form or other construction, as is well known in the technology. The two concurrently constructed structures, in effect, the caisson shield and the production platform, may be maintained apart while floating and being towed to the field through the utilization of nylon, kevlar and other material ropes interconnected between the two structures so as to maintain them in a predetermined physical and spaced relationship. These ropes should be of a length adequate to prevent the structures from colliding, but also afford sufficient slack and stretch to enable the lowering of the caisson shield to its position on the marine floor prior to the sinking of the offshore platform into its final operative position or vice versa.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
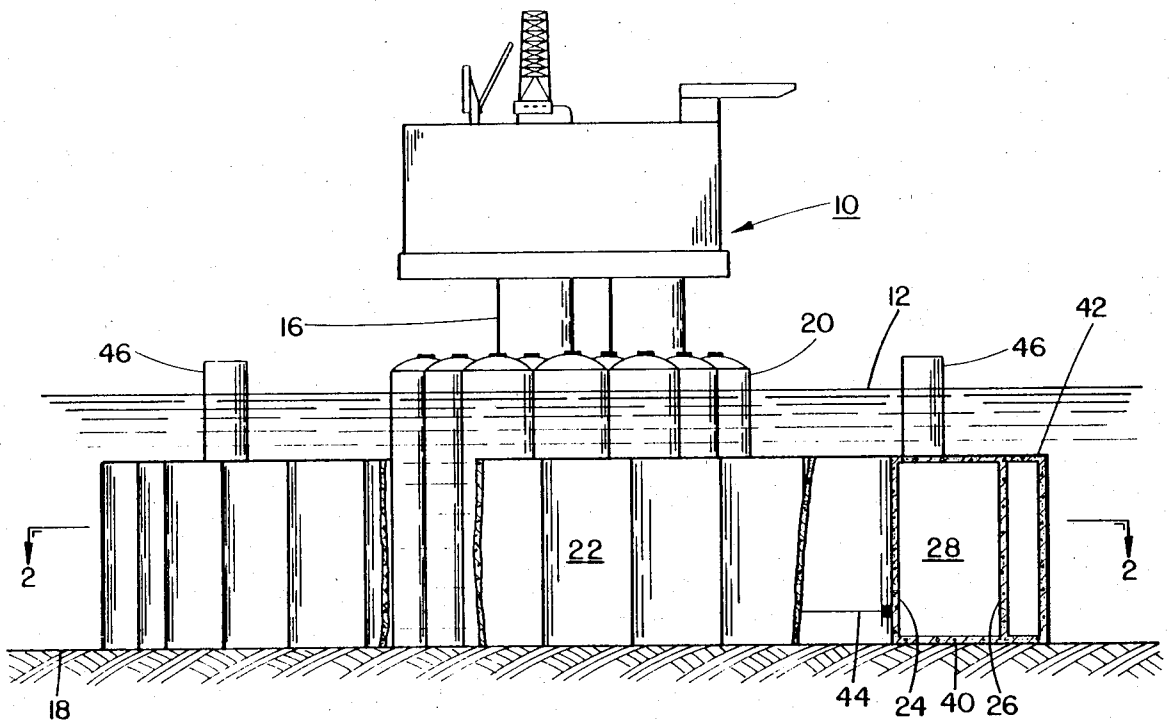
FIG. 1 illustrates a generally schematic, partly sectioned view of a caisson shield for protecting an offshore production platform in iceberg-infested waters.
Figure 2:
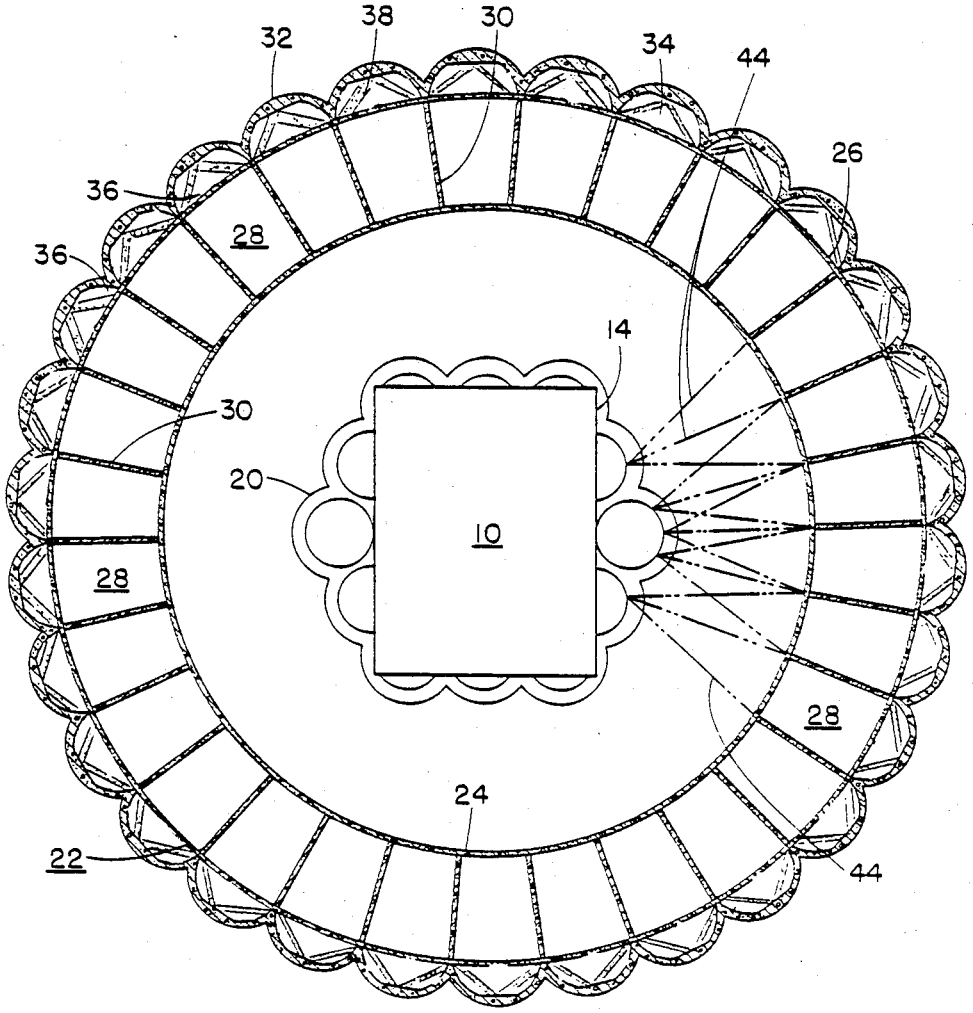
FIG. 2 illustrates a section through the caisson shield taken along line 2—2 in FIG. 1.

Referring now more particularly to FIGS. 1 and 2 of the drawings, illustrative of a first embodiment of the invention, shown therein is an offshore production platform 10 located in its final production position in a body of water 12. The production platform 10 includes a structure 14 extending down to and supported on the marine bottom 18 and which may further consist of a number of reinforced support wall structures 20, of which, at least some comprise cells or compartments for oil storage and related facilities.

A caisson shield 22 of a generally annular configuration, as shown in FIG. 2, extends about the offshore production platform 10. The illustrated caisson shield 22, in the configuration as shown, is suitable for use in water depths of approximately 400 feet and less. The caisson shield 22 is constructed of prestressed and reinforced concrete employing manufacturing techniques normally utilized in gravity structures, caissons and dry docks. As more clearly illustrated in FIG. 2, the caisson shield 22 is of a compartmented construction and includes annular concentrically arranged inner and outer walls 24, 26 which are circumferentially subdivided into individual compartments 28 through radial partition walls 30. Extending outwardly along the outer circumferential surface of the outer wall 26 are a plurality of arcuately arched outer wall sections 32 which impart a "scallop-like" configuration to the exterior of the caisson shield 22. The interior of each of the outer arched wall sections 32 is subdivided into a number of small compartments 34 and 36 by partition walls 38. The entire caisson shield structure 22 is supported on a bottom slab 40 which rests on the marine bottom 18. The top of the caisson shield structure 22 is covered by a top slab 42 so that each of the compartments within the shield structure is essentially closed and communicates with the exterior only through suitable ballasting and pumpout piping (not shown).

The plurality of compartments 28 within the caisson shield 22 provides for an arrangement of shortspan walls for resisting hydrostatic pressures and also for imparting ballasting and refloating capabilities required by the caisson shield during construction, installation and possible removal of the structure. The compartments 34 and 36 in the outer arcuately arched wall sections 32 form an exterior barrier for resisting iceberg impact forces and, in actuality, may be constituted of any arrangement of straight or curved walls which are suitable for resisting high punching shear loads. The compartments 34 and 36 may be filled with solid ballast, such as compacted sand or iron ore, to further resist the high but localized floating iceberg impact forces. Compartments 28 are generally ballasted by being filled with water in the submerged on site position of the caisson shield 22.

The caisson shield 22 which generally has an extremely heavy weight due to its massive construction, particularly when submerged and ballasted, will have a sufficient factor of safety against sliding along the marine bottom except in the case of impact by an exceptionally or unusually large and massive iceberg which may, conceivably, damage the outer caisson wall structure locally and/or slightly displace the caisson shield along the marine floor. It is also possible that the preferred configuration of this embodiment may or may not have reinforcing skirts (not shown) embedded in the marine bottom. Additionally, if desired, the outer surface of each of the arched wall sections 32 may be covered with steel sheathing to further enhance the strength thereof, Generally, in actual practice, the caisson shield structure 22 of FIGS. 1 and 2 may have an outside diameter of about 200 meters and an inside diameter of about 150 meters and is designed so as to be radially spaced from the offshore production platform 10 by a distance of about 15 to 25 meters.

As illustrated in phantom-lines in FIG. 2 of the drawings, synthetic or other material ropes (shown only in part) may be connected between the production platform well structure 20 and the caisson shield structure 22, preferable in the arrangement illustrated in radially extending directions along the entire circumference of these structures. These ropes are generally connected while the structures are in the graving dock, to the lower portion of the inner annular wall of the compartments 28 and the platform support structure 20. The ropes 44 are provided with sufficient slack to allow ballasting operations for the platform 10 and the caisson shield 22 to take place without undue tension being imparted to the ropes during these operations. In any event, the slack in the ropes 44 is limited so as to avoid any collision taking place between the production platform 10 and the caisson shield 22. When, for any reason, a ballasting sequence is not possible with an arrangement of fixed ropes 44, they are then disconnected during the above-mentioned operations, and conventional anchoring procedures may be employed in lieu thereof. The ropes 44 are disconnected and removed when the platform 10 and the caisson shield 22 are ballasted and sunk on location on the marine bottom.

Shown in FIG. 1 is a caisson 46 extending from the top of a compartment 28 to above the marine surface. This caisson 46, of which more than one may be provided, is employed for communication between the compartments 28 and above the marine surface, for facilitating ballasting of the compartments and for pumpout piping (not shown). This piping generally interconnects the compartments 28 in groups, preferably about five compartments to each group. Consequently, if any major damage is sustained by the walls of the compartments 28 of any specific group, such as may result from impact by an exceptionally large iceberg, the caisson shield 22 will be recoverable at the end of the field life by deballasting the remaining groups of compartments and without requiring rehabilitations of the caisson shield 22.

Furthermore, although the caisson shield 22 has been illustrated as being constructed of a single or unitary monolithic structure, it is possible that it be subdivided into arcuate or pie-shaped segments each having three, four or five compartments 28 associated therewith so as to be replaceable in sections, if required. These segments may be suitably keyed and interlocked, so as to form an integral annular caisson shield arrangement.

What is claimed is:

1. An offshore production platform structure for use in iceberg-infested waters comprising:

an above-water platform section;

a support section extending from the marine floor to said platform section; and a massive annular caisson shield spaced radially outwardly from said support section and extending from the marine floor toward the marine surface;

said caisson shield comprising an inner wall, an outer wall, a plurality of closed compartments formed between said inner wall and said outer wall, and a plurality of arched wall sections extending radially outwardly from said outer wall;

said arched wall sections being constructed to progressively crush the leading edge of an impacting iceberg, said closed compartments being constructed to absorb maximum anticipated ice thrust forces including local punching failure of said outer wall, and said caisson shield being constructed to slide laterally while maximum anticipated ice thrust forces are being dissipated.

2. The platform structure of claim 1 wherein said closed compartments are formed by a plurality of annularly spaced radially extending wall sections interconnecting said inner wall and said outer wall.

3. The platform structure of claim 1 wherein said arched wall sections are contiguously arranged about said outer wall to impart a generally scallop-shaped exterior configuration.

4. The platform structure of claim 3 wherein each of said arched wall sections includes internal partition wall means for subdividing each of said arched wall sections into a plurality of closed chambers.

5. The platform structure of claim 4 further comprising ballast filling each of said closed chambers.

6. The platform structure of claim 5 wherein said ballast comprises sea water filling at least some of said closed chambers.

7. The platform structure of claim 5 wherein said ballast comprises compacted sand filling at least some of said closed chambers.

8. The platform structure of claim 5 wherein said ballast comprises iron ore filling at least some of said closed chambers.

9. The platform structure of claim 1 further comprising a generally horizontal slab member supporting said caisson shield on the marine floor for allowing limited movement therealong responsive to excessive external lateral force caused by an iceberg.

10. The platform structure of claim 9 further comprising another horizontal slab member convering the top of said caisson shield to form the top wall of said closed compartments.

11. The platform structure of claim 1 wherein said caisson shield has a vertical height terminating below the marine surface to allow for access of marine traffic to said above-water platform section.

12. The platform structure of claim 1 wherein said caisson shield is a unitary monolithic structure.

13. The platform structure of claim 1 wherein said caisson shield is formed from a plurality of monolithic arcuate sections.

14. The platform structure of claim 1 wherein said caisson shield is formed of essentially prestressed and reinforced concrete.

15. The platform structure of claim 1 wherein said caisson shield has an outer diameter of about 200 meters and an inner diameter of about 150 meters.

16. The platform structure of claim 1 wherein said caisson shield has a radial spacing from said support section of about 15 to 25 meters.

17. The platform structure of claim 1 further comprising steel sheathing along the outer surfaces of said arched wall sections.

* * * * *